US010245201B2

(12) United States Patent
Allen

(10) Patent No.: US 10,245,201 B2
(45) **Date of Patent: *Apr. 2, 2019**

(54) TRENDELENBURG PATIENT RESTRAINT FOR SURGERY TABLES

(71) Applicant: Robert Dan Allen, Newbury, OH (US)

(72) Inventor: Robert Dan Allen, Newbury, OH (US)

( * ) Notice: Subject to any disclaimer, the term of this patent is extended or adjusted under 35 U.S.C. 154(b) by 630 days.

This patent is subject to a terminal disclaimer.

(21) Appl. No.: 14/864,141

(22) Filed: Sep. 24, 2015

(65) Prior Publication Data

US 2016/0008200 A1 Jan. 14, 2016

Related U.S. Application Data

(63) Continuation of application No. 14/195,289, filed on Mar. 3, 2014, now Pat. No. 9,149,406.

(60) Provisional application No. 61/772,154, filed on Mar. 4, 2013.

(51) Int. Cl.
*A61G 13/12* (2006.01)
*A61G 13/04* (2006.01)

(52) U.S. Cl.
CPC ..... *A61G 13/121* (2013.01); *A61G 13/04* (2013.01); *A61G 13/122* (2013.01); *A61G 13/1255* (2013.01)

(58) Field of Classification Search
CPC .... A61G 13/04; A61G 13/121; A61G 13/122; A61G 13/1255
USPC ..... 128/845; 5/607, 622, 637; 602/33
See application file for complete search history.

(56) References Cited

U.S. PATENT DOCUMENTS

| | | | | |
|---|---|---|---|---|
| 3,844,550 A | | 10/1974 | McGuire | |
| 4,114,612 A | * | 9/1978 | Benjamin | A47G 9/1009 482/10 |
| 4,166,459 A | * | 9/1979 | Nightingale | A61H 1/0218 5/636 |
| 4,275,472 A | | 6/1981 | Erck | |
| 4,583,725 A | | 4/1986 | Arnold | |
| 4,771,493 A | * | 9/1988 | Park | A47G 9/1009 5/603 |

(Continued)

OTHER PUBLICATIONS

Hewer, C. Langton; "The Physiology and Complication of the Trendelenburg Position"; Canad. M. A. J; Feb. 15, 1956, vol. 74; pp. 286-288.

(Continued)

*Primary Examiner* — Robert G Santos
*Assistant Examiner* — Rahib T Zaman
(74) *Attorney, Agent, or Firm* — Pearne & Gordon LLP

(57) ABSTRACT

A patient positioning device is provided for restraining movement of a body lying over a top surface of a table. The device includes a cervical-thoracic notch restraint that includes a base with a first side and an opposed second side. The first side defines a substantially flat plane with a repositionable fastener, and the second side defines a substantially flat plane with a raised, curved support extending transversely across the base. In an operational state, the curved support is configured to nest into an anatomical cervical-thoracic notch of the body lying over the table to abut a trapezius muscle of the body. In one example, a rigid support frame extends transversely over the top surface of the table, and the cervical-thoracic notch restraint is securely fixed to the upper support surface of the support frame.

20 Claims, 6 Drawing Sheets

(56) References Cited

U.S. PATENT DOCUMENTS 4,805,603 A * 2/1989 Cumberland ..... A47G 9/1027 128/DIG. 20
4,832,007 A * 5/1989 Davis, Jr. ..... A47G 9/1081 250/580
4,858,260 A 8/1989 Failor et al.
5,067,483 A 11/1991 Freed
D323,218 S * 1/1992 Kamensky ..... D24/191
5,090,073 A 2/1992 Nordan et al.
5,146,641 A 9/1992 Zwickey
5,265,625 A * 11/1993 Bodman ..... A61F 5/3707 128/870
5,267,931 A * 12/1993 Faetini ..... A61H 1/0296 128/DIG. 23
5,275,176 A 1/1994 Chandler
5,279,310 A * 1/1994 Hsien ..... A61F 5/01 128/DIG. 20
5,382,226 A * 1/1995 Graham ..... A61H 1/0218 128/845
5,390,383 A 2/1995 Carn
5,662,597 A 9/1997 Chitwood
5,664,271 A 9/1997 Bellavance
5,724,992 A 3/1998 Ip
5,754,997 A 5/1998 Lussi et al.
5,771,512 A 6/1998 Kurakake et al.
5,916,073 A 6/1999 Ellis
6,003,176 A 12/1999 Wasley et al.
6,182,311 B1 2/2001 Buchanan et al.
6,216,294 B1 4/2001 Wess
6,260,220 B1 7/2001 Lamb et al.
6,298,507 B1 10/2001 Clyburn
6,311,349 B1 11/2001 Kazakia et al.
6,622,324 B2 9/2003 Van Steenburg et al.
6,754,923 B2 6/2004 Borders et al.
6,880,189 B2 4/2005 Welling et al.
6,941,951 B2 9/2005 Hubert et al.
7,003,828 B2 2/2006 Roussy
7,017,211 B2 3/2006 Krywiczanin et al.
7,020,917 B1 4/2006 Kolody et al.
D531,682 S 11/2006 Farris, Jr.
7,137,160 B2 11/2006 Hand et al.
7,152,261 B2 12/2006 Jackson
7,297,127 B2 * 11/2007 Lee ..... A61F 5/055 128/DIG. 23
7,347,834 B2 * 3/2008 Han ..... A61F 5/04 602/32
8,251,939 B2 * 8/2012 Aune ..... A61H 1/0296 602/18
8,594,273 B2 * 11/2013 Ishii ..... A61B 6/04 378/20
8,734,372 B1 * 5/2014 Graham ..... A61F 5/042 5/636
9,032,961 B2 5/2015 Zhang
9,186,004 B2 * 11/2015 Dennewald ..... A47G 9/1081
2002/0157186 A1 10/2002 VanSteenburg et al.
2003/0167569 A1 9/2003 Newkirk et al.
2007/0089239 A1 4/2007 Whiteside
2008/0034502 A1 2/2008 Copeland et al.
2010/0242177 A1 9/2010 Malcolm et al.
2010/0325803 A1 * 12/2010 Requena ..... A47G 9/10 5/640
2013/0205504 A1 8/2013 Ratner

OTHER PUBLICATIONS

Allen, D.; "Patient Positioning for Robotic Surgery an insider's perspective"; OR Today; Jun. 2012; pp. 20-22.
Allen, D.; "Positioning and the Surgical Robot"; FOCUS ON: Patient and Safety: Tables and Positioning Surgical Products; Jan. 2013; 5 pages.
"Velcro Brand Woven Hook and Loop"; Velcro Industries B.V.; 2010.
TrenGuard 450 Trendelenburg Patient Restraint User Reference Guide; 2015.
Song; "Sever brachial plexus injury after retropubic radical prostatectomy"; The Korean Society of Anesthesiologists; Jul. 2012; vol. 63(1); pp. 68-71.
Instructions for use—TrenGuard 450/600 Trendelenburg Patient Restraint; dated Apr. 1, 2015.
"The use of shoulder braces as Trendelenburg Restraints"; D.A. Surgical, 2015.
"Aorn Guidelines for Trendelenburg Positioning"; Perioperative Standards and Recommended Practices; 2009.

* cited by examiner

TRENDELENBURG PATIENT RESTRAINT FOR SURGERY TABLES

CROSS-REFERENCE TO RELATED APPLICATIONS

This application is a continuation of U.S. application Ser. No. 14/195,289 filed Mar. 3, 2014, which claimed the benefit of U.S. Provisional Application No. 61/772,154 filed Mar. 4, 2013, the entire disclosures of which are hereby incorporated herein by reference.

FIELD OF THE INVENTION

The present invention relates generally to patient restraints for surgery tables, and more particularly, to a patient positioning device mounted to an operating room table.

BACKGROUND OF THE INVENTION

A number of operating room table accessory devices have been developed in an attempt to restrain patients from sliding downwards on the table when the table is tipped into a head down angulation. This position is known in the industry as the Trendelenburg position. The Trendelenburg position is often utilized when internal visualization of and access to the pelvis is required for robotic assisted laparoscopic surgery, minimally invasive surgery and traditional open surgery. When the Trendelenburg position is achieved, gravity causes the internal organs to shift toward the head thereby improving visualization and surgeon access to the pelvic anatomy. The medical literature shows that if the patient is not restrained when they are placed into the Trendelenburg position, then there is a real risk that the patient will slide off the table suffering severe or life ending injury.

Several devices are described in the medical literature as being effective in anchoring the patient in position to keep them from sliding on the table. The medical literature shows clearly that using fixed shoulder braces to restrain patients from sliding is effective. However, the medical literature also makes clear that these devices commonly cause serious nerve damage and strongly cautions against the use of shoulder braces. For example, it is known that with the use of shoulder braces, the combination of gravity and the patient's weight forces or "funnels" the patient's mass between the braces. This distorts the clavicle, which places direct pressure on the brachial plexus, which is to be avoided. It is further known that extra padding on shoulder braces does not reduce patient risk, stop funneling or reduce the cause of brachial plexus injury. A number of other contemporary alternatives, such as restraining the patient directly to the surgical table using tape and foam, may keep the patient from sliding off the table with little risk of nerve injury. Even so, it is not uncommon that during the course of traditional laparoscopic and open surgical procedures for the devices and/or the patients to slide anywhere from 1 to 8 inches during the course of a surgical procedure. The sliding occurs quite slowly and gradually, and commonly becomes obvious only at the end of the procedure after removal of protective surgical drapes. It most often presents as a noticeable reduction of leg flexion when utilizing booted stirrups. When performing conventional minimally invasive surgical procedures the concern for patient risk due to sliding a few inches when in Trendelenburg appears to have been relatively low. This, however, is not so for robotic procedures.

With the advent of robotic assisted laparoscopic surgery, many procedures are done in the most extreme Trendelenburg postures available from the surgical table. The angle of head down tilt typically ranges from 30° to 45° with respect to a ground surface. Patients' sliding on the table during robotic surgery is becoming recognized globally as a serious patient positioning risk. Sliding during robotic surgery places the patient at serious risk for injury at the site where the surgical instruments and visualization equipment enter the patient. The effects of patients sliding while in the Trendelenburg position during robotic surgery cannot be ignored because the robot is not programmed to detect if a patient is moving or sliding on the table. When a patient slides, even just one half of an inch, the robot is not programmed to adjust either the mechanical arms or instruments to the change in the patient's position on the table. Therefore, when a patient slides during robotic assisted surgical procedures, the robotic arms and instruments remain in their fixed location as programmed. This can result in the added sliding weight of the patient being shifted from the restraint device to the robotic arms and the attached instruments. Ultimately, the patient may be restrained by the instruments entering the body and trocars. This has been ironically referred to as "the meat hook" restraint technique. Analysis of the medical literature suggests that patient injuries from sliding on the table during robotic procedures will present as incisional tear, post-operative hernia formation, and increased postoperative pain secondary to overstretching of the anterior abdominal wall causing severe and prolonged post-operative pain, bruising or even necrosis at the primary sites of instrument and camera entry.

Some examples of this type of bracing and restraining devices are disclosed in U.S. Pat. No. 5,090,073 to Nordan et al. and U.S. Pat. No. 6,622,324 to Van Steenburg et. al., the latter being an advanced representation of the current state of the art. The instant invention provides an innovative device that eliminates or minimizes intraprocedural patient sliding, meets or exceeds the clinical needs for safety, provides acceptable anesthesia access and surgical site exposure, and offers an intuitive design that is easy and fast to use.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a patient positioning device is provided for restraining movement of a body lying over a top surface of a table with a rigid support frame secured to and extending transversely over said top surface of said table. A cervical-thoracic notch restraint is formed of a resiliently deformable material and comprises a base comprising a first side and an opposed second side. The first side defines a substantially flat plane with a repositionable fastener configured to be securely fixed to an upper support surface of said support frame to thereby inhibit movement of the cervical-thoracic notch restraint along a longitudinal axis of said table. The second side defines a substantially flat plane with a raised, curved support extending transversely across the base and comprises a mound prominently extending upwards from the substantially flat plane of the second side. In an operational state, the curved support is configured to nest into an anatomical cervical-thoracic notch of said body lying over said table to abut a trapezius muscle of said body. The curved support is load-bearing to thereby apply a resisting force against the trapezius muscle and a spinal column of said body that is sufficient to substantially completely resist movement of said body along the longitudinal axis of said table.

In accordance with another aspect of the present invention, a patient positioning device is provided for restraining movement of a body lying over a top surface of a table. A rigid support frame is secured to and extends transversely over the top surface of said table, comprising an upper support surface and a repositionable fastener secured to the upper support surface. A cervical-thoracic notch restraint includes a load-bearing resilient foam material and is securely fixed to the upper support surface of the support frame, via the repositionable fastener, to thereby inhibit movement of the cervical-thoracic notch restraint along a longitudinal axis of said table. The cervical-thoracic notch restraint comprises a base with a first side and a second side, the first side comprising a repositionable fastener compatible with the repositionable fastener of the upper support surface. The second side defines a substantially flat plane with a first extended portion and a second extended portion, and comprising a raised, curved support located between the first and second extended portions and comprising a mound prominently extending upwards from the second side of the base that, in an operational state, is configured to nest into an anatomical cervical-thoracic notch of said body lying over said table and abut a trapezius muscle of said body to thereby apply a resisting force against the trapezius muscle and a spinal column of said body that is sufficient to substantially completely resist movement of said body along the longitudinal axis of said table. The resilient foam material of the cervical-thoracic notch restraint is sufficiently load-bearing to maintain contact with the trapezius muscle of said body and support a force of at least 450 pounds directed along the longitudinal axis of said table when the top surface of said table is oriented in an inclined position relative to a ground surface.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
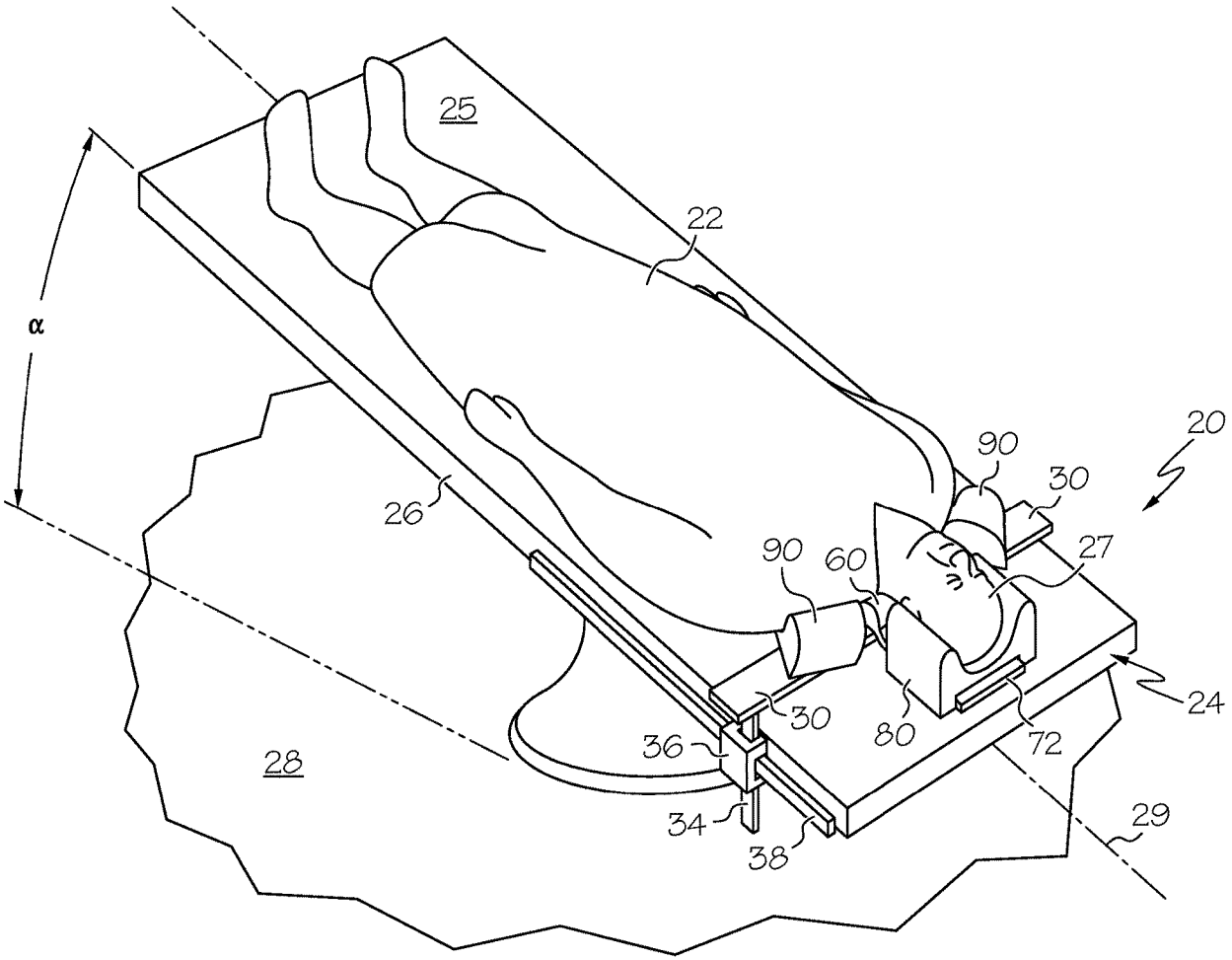
FIG. 1 illustrates use of the patient positioning device for bracing and restraining a patient's body lying upon the top surface of a longitudinally tilted surgical table.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

The present application relates generally to patient restraints for surgery tables, and more particularly, to a patient positioning device mounted to an operating room table that is used to support, restrain, posture or expose the entirety of, or any portion of, a patient's anatomy before, during or after the completion of any surgical procedure or intervention. The primary role of the device is to utilize the natural anatomical concavities of the patient and other portions of the anatomy to posture and support the patient and thereby keep the patient from sliding during any surgical procedure, such as those procedures performed in the head-down Trendelenburg position.

Turning to FIG. 1, the patent positioning device 20 is used to restrain movement of the patient's body 22 from sliding towards the lowered head end 24 of the operating room table 26. The patient positioning device 20 is mounted to the operating room table 26 for restraining the weight and gravity induced, head down sliding movement of the patient's body 22 lying over the top surface 25 of the operating room table 26. The table 26 is capable of longitudinal, front to back incremental angling ranging from an angle $\alpha$ of less than 1° to greater than 20° (and possibly greater than 50°) relative to the floor surface 28. There is shown in FIG. 1, a patient's body lying upon the top surface 25 of the tiltable operating room table 26 in the Trendelenburg (head down) position. Thus, despite the angled table, the patient's body 22 is restrained from sliding toward the lowered head end 24 of the operating room table 26 by the patent positioning device 20 according to the instant application.

Figure 2:
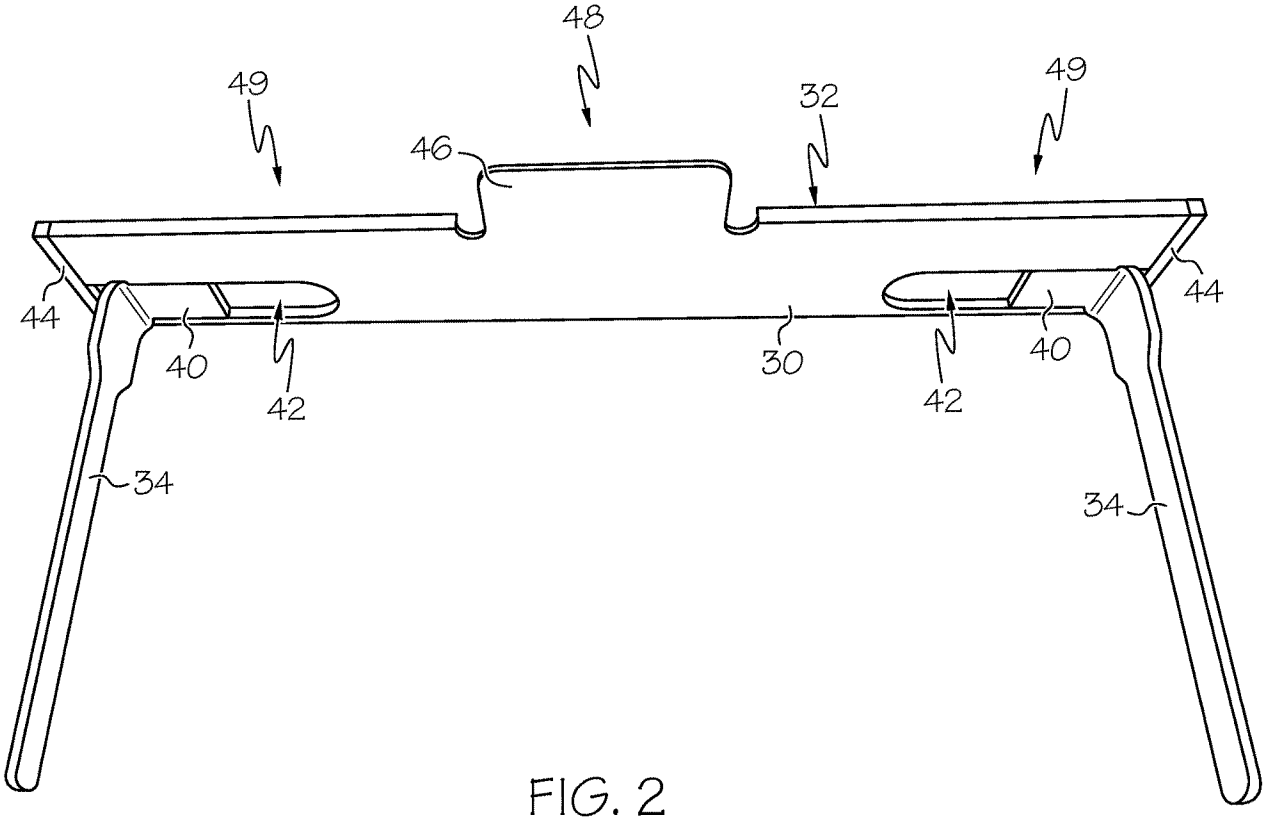
FIG. 2 illustrates an example support frame of the patient positioning device.
Figure 3:
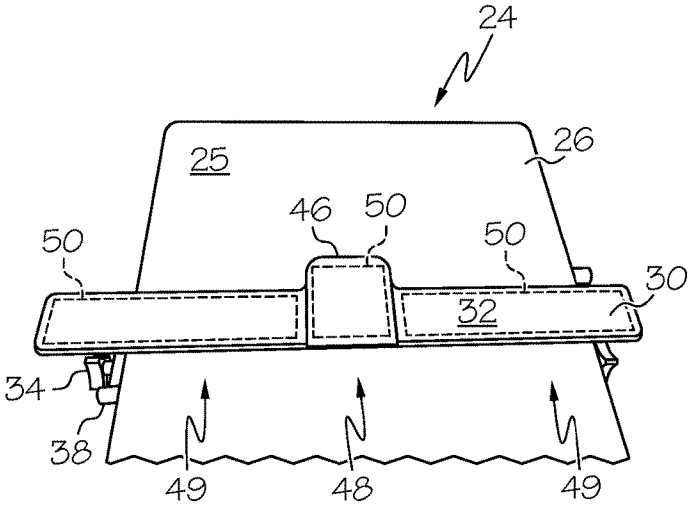
FIG. 3 illustrates placement of the support frame upon the surgical table.

In some embodiments there is provided, in association with the operating room table, a rigid support frame 30 extending transversely over the top surface 25 of the table 26. Turning to FIGS. 2-3, the rigid support frame 30 includes an upper support surface 32 and a pair of legs 34 that are secured to the operating room table 26 to inhibit movement of the rigid support frame 30 and upper support surface 32 along a longitudinal axis 29 of the table 26. The rigid support frame 30 can have of varying widths and depths spanning across the top surface 25 of the table 26. Although only a single support frame 30 is illustrated, it is contemplated that two or more support frames can be used. In one example, the rigid support frame 30 extends transversely over the top surface 25 of the table 26 so as to be substantially perpendicular to the longitudinal axis 29 of the table 26, although in other examples the rigid support frame 30 extends transversely over the top surface 25 of the table 26 at other angles. The rigid support frame 30 is preferably made of durable, rigid materials that are suitable for use in an operating room and surgical setting, such as various metals (e.g., stainless steel, aluminum, etc.) and plastics.

The support frame 30 is attached to the operating room table 26 by the pair of legs 34 at each end of the support frame 30. The legs 34 can have various geometries, such as blades or posts, suitable to be secured to the table 26. In one example, the pair of legs 34 are shaped and dimensioned to be inserted to be inserted into accessory clamps 36 that are customarily associated with fixing accessories attached to an accessory mounting rail 38 which is coupled to or integral with to operating room tables 26. The pair of legs 34 can be secured to the support frame 30 with a fixed width, or can be laterally slidable on the support frame 30 to be width-adjustable to be more useful with different tables 26 having different widths and configurations. In one example, an upper end 40 of the legs 34 can be slidably received within a channel 42 or groove formed into the bottom surface of the support frame 30, such that the width between the legs 34 is adjusted by sliding either or both legs within their respective channels 42. Preferably, both of the legs 34 are independently width-adjustable, and either can include selective locking structure. The upper end 40 of the leg 34 can be retained within the channel 42 in various manners. In one example, the upper end 40 of each leg 34 and the channel 42 can each have a mating dovetail geometry that permits relative sliding movement while also retaining the end 40 within the channel 42, although various other geometries are contemplated. In addition or alternatively, an end cap 44 can be removably or non-removably secured to the support frame 30 to close off the channel 42 and retain the upper end 40 of the leg 34. It is also contemplated that the legs 34 can be width-adjustable using other structure, such as linear slides and the like, clamps with an array of screw-down points, etc. The pair of legs 34 are preferably perpendicular to the upper support surface 32, but can also be arranged a various other angles.

The support frame 30 can further include an extension plate 46, located about a central portion 48 of the support frame 30, that increases a length of the upper support surface 32 in a direction along the longitudinal axis 29 of the table 26. The central portion 48 is located between an opposed pair of outward portions 49 of the support frame 30. The extension plate 46 can provide additional surface area to increase the holding force of restraints, supports or stabilizers that are resisting movement of the body 22 towards the head end 24 of the table 26. Preferably, the extension plate 46 is oriented so as to be relatively closer to the head end 24 of the table 26, as shown in FIG. 3, to increase patient comfort such that the patient does not feel the extension plate 46 underneath their neck or upper back. Additionally, to further increase patient comfort, both of the central portion 48 and the extension plate 46 can each comprise a reduced-thickness section, as compared to the thickness of the outward portions 49 of the support frame 30. In one example, the support frame 30 can have a thickness of about ⅜" (9.5 mm) at the outward portions 49, and a reduced thickness of about ⅛-3/16" (3-5 mm) at the central portion 48, although other values are contemplated. Preferably, the reduced-thickness section has a width at least equal to, and more preferably slightly larger than, the width of a restraint, support or stabilizer secured thereupon. In various examples, the reduced-thickness section can have a width of 6-9" (150-230 mm), although other values are contemplated.

Additionally, located on the upper support surface 32 of the rigid support frame 30, may be one or more physical or visual guides allowing highly specific, precise and repeatable placement of any or all of the restraints, supports and stabilizers described herein. Further, it should be noted that the thickness of the support frame 30 is such that there are no vertical posts or arms extending above the upper support surface 32 that could interfere with a surgeon or their assistant or obstruct the patient's body 22 during transfer on or off the operating room table 26.

The rigid support frame 30 further includes an aggressive, releasable, and repositionable fastener 50 across all or a portion of the upper support surface 32. The repositionable fastener 50 allows adjustable, patient specific, placement of one or more restraints, supports or stabilizers upon the rigid support frame 30. Preferably, the repositionable fastener 50 allows substantially infinite adjustment of the restraints, supports or stabilizers upon the upper support surface 32. Any or all off the restraints, supports or stabilizers may also have a compatible, aggressive, releasable and repositionable fastener system for coupling to the support frame 30. The repositionable fastener 50 can be disposed partially or completely over the upper support surface 32 of the support frame 30 as one single continuous unit, or two or more separate units on the central portion 48 and outward portions 49. If separate units are used, the repositionable fastener 50 can have the same or different strengths or other properties on each of the central portion 48 and outward portions 49. In one example, the repositionable fastener 50 comprises a hook-and-loop type fastener. In other examples, the repositionable fastener 50 includes snaps, hooks, clasps, clips, elastic members, tape, removable or non-permanent adhesives, etc. or combinations thereof.

As noted above, the extension plate 46 increases a length of the upper support surface 32 in a direction along the longitudinal axis 29 of the table, and does so to thereby increase a combined attachment surface area of the upper support surface 32 along the longitudinal axis 29 of said table 26. The increased combined attachment surface can provide relatively more strength oriented in the longitudinal direction of the patient's slipping movement. The repositionable fastener 50 is secured to the upper support surface 32 over the combined attachment surface area. As a result, the repositionable fastener 50 comprises a holding strength per unit of surface area that, when applied over the combined attachment surface area, is sufficient to support a force of at least 450 pounds, and more preferably at least 700 pounds, directed along the longitudinal axis 29 of the table 26 when the top surface 25 of the table 26 is oriented in an inclined position relative to the ground surface 28. The repositionable fastener 50 preferably has a holding strength per unit of surface area greater than 15 pounds per square inch, and more preferably a holding strength greater than 20-30 pounds per square inch. In one example, the repositionable fastener 50 has a holding strength of 22 pounds per square inch, and the combined attachment surface area provides an attachment area of approximately 36 square inches (232 square centimeters). Thus, the repositionable fastener 50 can support a shear force of at least 792 pounds (359 kg) directed along the longitudinal axis 29 of the table 26. In a further example, the combined attachment surface area provides approximately 48 square inches (310 square centimeters) such that the repositionable fastener 50 can support a shear force of at least 1056 pounds (479 kg) directed along the longitudinal axis 29. In still a further example, the combined attachment surface area provides approximately 60 square inches (387 square centimeters) such that the repositionable fastener 50 can support a shear force of at least 1320 pounds (598 kg) directed along the longitudinal axis 29. It is understood that the amount of force to be supported along the longitudinal axis 29 can be adjusted as desired based upon the expected range of body weights of the various unique patients, and moreover that the support force may provide an industry-acceptable margin of safety. Finally, it is noted that due to the algebraic geometry of the inclined table 26, the repositionable fastener 50 may only support a portion of a patient's body weight (e.g., shear force supported=sin $\alpha$*patient's body weight), although that portion supported by the repositionable fastener 50 will increase as the angle $\alpha$ of the table increases.

One or more patient posturing and positioning aids may be fastened to the upper support surface 32 of the support frame 30, including any or all of: cervical-thoracic notch restraint, head support, head stabilizer, shoulder supports, a lateral stabilizing pillow, Achilles support, sacral support and/or such other padded or unpadded torsional supports or stabilizers which may be used to assist in safe and appropriate patient posturing or positioning. The design of the supports or stabilizers allows for infinite lateral, medial and rotational modification of their location and orientation on the support frame so as to permit customization for the body of each unique patient.

Figure 4:
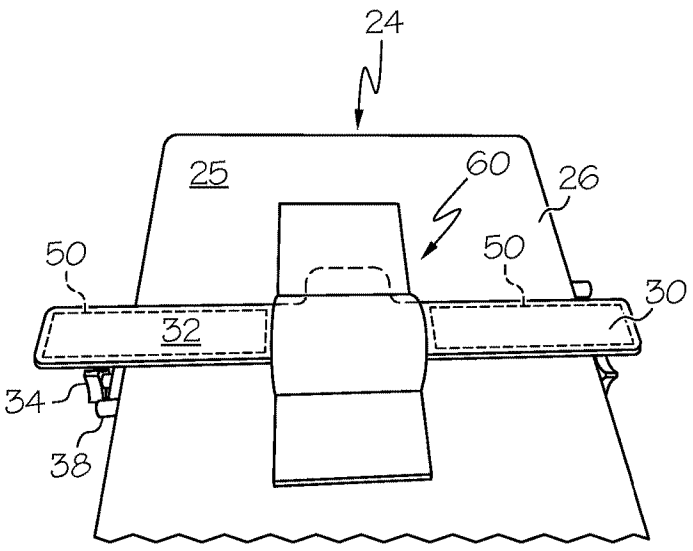
FIG. 4 illustrates an example restraint secured to the support frame.
Figure 5:
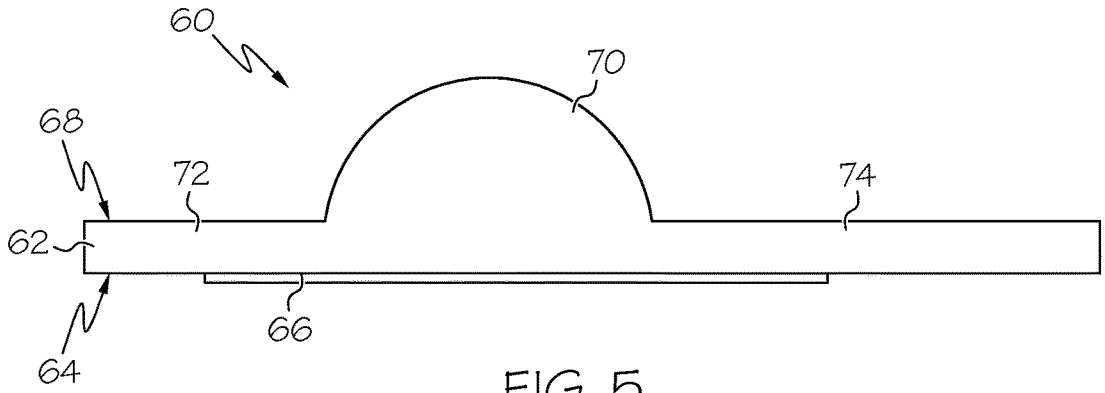
FIG. 5 illustrates a side view of the example restraint.
Figure 6:
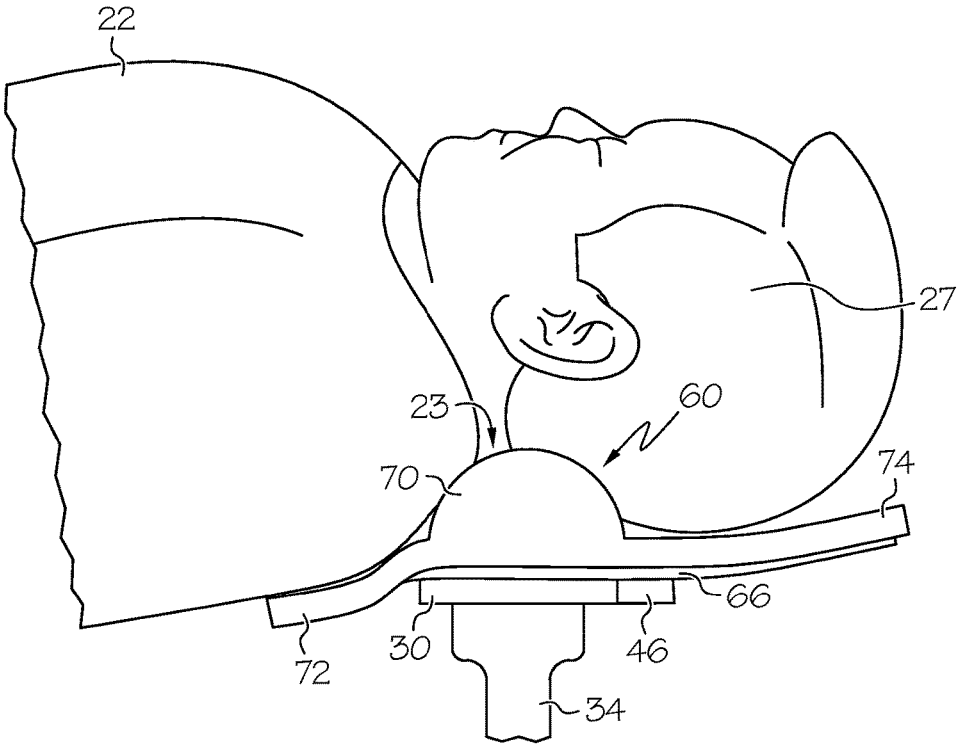
FIG. 6 illustrates an interaction of the restraint with a patient upon the surgical table.

Turning now to FIGS. 4-6, the patient positioning device 20 further includes a cervical-thoracic notch restraint 60 securely fixed to the upper support surface 32 of the support frame 30, via a repositionable fastener, to thereby inhibit movement of the cervical-thoracic notch restraint 60 along the longitudinal axis 29 of the table 26. Preferably, the cervical-thoracic notch restraint 60 is positioned centrally upon the support frame 30 (such as at the central portion 48). The cervical-thoracic notch restraint 60 utilizes the anatomical cervical-thoracic notch concavity 23 of the human body to restrain the patient's body 22 from slipping movement toward the head 24 of the table 26. The anatomical cervical-thoracic notch concavity 23 is located generally at the nape of the neck (i.e., at the nucha or back of the neck), and more specifically about the juncture of the cervical vertebrae (i.e., those vertebrae immediately inferior to the skull) and the thoracic vertebrae (i.e., the segment of the vertebral column between the cervical vertebrae and the lumbar vertebrae). As will be described herein, the cervical-thoracic notch restraint 60 is intended to abut the trapezius muscle of the patient's body 22.

The cervical-thoracic notch restraint 60 includes a base 62 with a first side 64 comprising a repositionable fastener 66 compatible with the repositionable fastener 50 of the upper support surface 32. The repositionable fastener 66 on the base 62 can be the same, similar, or different from the repositionable fastener 50 of the support frame 30. Preferably, the repositionable fastener 66 on the base 62 is a hook-and-loop type fastener, although any of the other fasteners described herein are contemplated. The repositionable fastener 66 may cover some or all of the first side 64 of the base 62, and preferably covers a sufficient portion of the first side 64 to enable the cervical-thoracic notch restraint 60 to be positionally adjustable upon the upper support surface 32 of the support frame 30. As shown in FIG. 4, the base 62 of the cervical-thoracic notch restraint 60 can be securely fixed to the reduced-thickness central portion 48 of the upper support surface 32 of the support frame 30. This location can help to properly position and restrain the cervical-thoracic notch restraint 60 upon the support frame 30, and can also increase patient comfort by reducing the stack-up height of the components located underneath the neck or upper back.

The cervical-thoracic notch restraint 60 further includes a raised, curved support 70 extending upwards from a second side 68 of the base 62 that is configured to nest into the anatomical cervical-thoracic notch 23 of the body 22 lying over the table 26. The raised, curved support 70 is located between a first extended portion 72 and a relatively longer second extended portion 74 of base 62. The first extended portion 72 is oriented towards the patient's feet, while the second extended portion 74 is oriented towards the head end 24 of the table 26. The base 62 can include a relatively flat plane, although either of the first and second extended portions 72, 74 may also provide a tapered or tamped geometry leading towards the raised, curved support. The juncture of the first extended portion 72 and the raised, curved support 70 can provide a location touchstone, aligned for example with an edge of the support frame 30, for properly positioning the cervical-thoracic notch restraint 60 upon the support frame 30. However, it is contemplated that the base 62 could not include either of the first and second extended portions 72, 74. In one example, the base 62 could include only the second extended portion 74, and front edge of the raised, curved support 70 could then provide the location touchstone for alignment with the front edge of the support frame 30. The raised, curved support 70 is fixed to or integrated with the base 62, and comprises a transverse mound configured to abut the trapezius muscle and be secure against the thoracic spine. The raised, curved support 70 has a geometry compatible with and conforming to an anatomical shape of the nucha of the body 22. The shape and form of the raised, curved support 70 may range from one or more compound curves to a singular transverse tubular radius, as may be used to nestle within the anatomical cervical-thoracic notch 23. In one example, the raised, curved support 70 has a semi-circular geometry of a substantially constant radius. Additionally, the relatively longer, second extended portion 74 can have a flat or textured surface extending toward the patient's head 27 beyond the raised, curved support 70 to create a surface to serve in the role of protecting the occiput of the patient's head 27 from pressure injury. The cervical-thoracic notch restraint 60 maybe padded or unpadded.

The cervical-thoracic notch restraint 60 is preferably formed as a monolithic body utilizing a single material, although it can be formed of multiple components and/or multiple materials. The material used should provide stability for patients ranging from 45 lbs to greater than 450 lbs, and preferably greater than 750 lbs. Additionally, the material can be a natural or synthetic material in such a size or density that will maintain its shape and function and provide and maintain sufficient resistance to the patient's weight and gravity to thereby causing the human body 22 to remain fixed in position upon the surface of the table 26. Preferably, the cervical-thoracic notch restraint 60 includes a deformable material, such as foam or the like, and more preferably the material is a resiliently deformable material. In one example, the cervical-thoracic notch restraint 60 is made of polyether-type polyurethane foam and has a density of at least 2 lbs per cubic foot, and more preferably at least 3 lbs per cubic foot. Additionally, the foam material preferably has an indentation load deflection (ILD) rating of at least 70 lbs., more preferably at least 80 lbs, and even more preferably at least 100 lbs. An ILD rating is hardness measurement of foam that is typically measured in the number of pounds of pressure required to indent the foam by 25% using a 50 square inch indentation (sometimes referred to as the 25% ILD rating).

As mentioned above, the cervical-thoracic notch restraint 60 can be a monolithic body, or can include two or more components. In one example, the restraint 60 can be manufactured from a single piece of foam or other unitary material. In another example, the restraint 60 can be co-manufactured (e.g., such as using fasteners, adhesives, co-molding, co-extrusion, etc.) using two or more materials. In a further example, the restraint 60 could have multiple layers of various hardness values, such as a most deformable material on the exterior followed by a relatively less deformable layer, and optionally followed by still one or more even less deformable layer(s). In still a further example, the restraint 60 could only partially include a deformable material, such as about an external portion thereof for contact with the body on the table. In such a situation, the restraint 60 could include a relatively stiff core (which may or may not be deformable), such as metal or plastic, that is covered by a deformable material that contacts the patient's body. The core could be reusable, while the outer, deformable covering could be disposable. The outer covering could be removably or non-removably secured to the inner core in various manners, such as via any of the repositionable fasteners discussed herein or even using more permanent fasteners, such as adhesives, welding, etc. or co-molding, co-extruding, etc. Moreover, the restraint 60 can be disposable, limited use or reusable. In a reusable configuration, the restraint 60 can include an outer covering that is either replaceable (e.g., a washable or single-use covering) or the outer covering can be non-replaceable but suitable to be cleaned and sanitized per medical standards. For example, the restraint 60 could have a plastic, gel or other medically-suitable material coated, laminated, etc. on its exterior. Preferably, the outer covering is deformable to move together with the restraint 60.

In use, the raised, curved support 70 of the cervical-thoracic notch restraint 60 nests within the anatomical cervical-thoracic notch 23 and abuts the trapezius muscle of the patient's body 22 to thereby apply a resisting force against the trapezius muscle and spinal column to support the body 22 from slipping movement towards the head 24 of the table 26. The sliding force of the patient's body 22 is resisted completely or substantially completely by the cervical-thoracic notch restraint 60 via the engagement of the repositionable fasteners 50, 66, and is ultimately transmitted to the table 26 via the legs 34 of the support frame 30. Thus, when the surface 25 of the table 26 is inclined in the head-down Trendelenburg position, the cervical-thoracic notch restraint 60 inhibits, such as prevents, substantially all movement of the body 22 relative to the head end 24 of the table 26.

Figure 7:
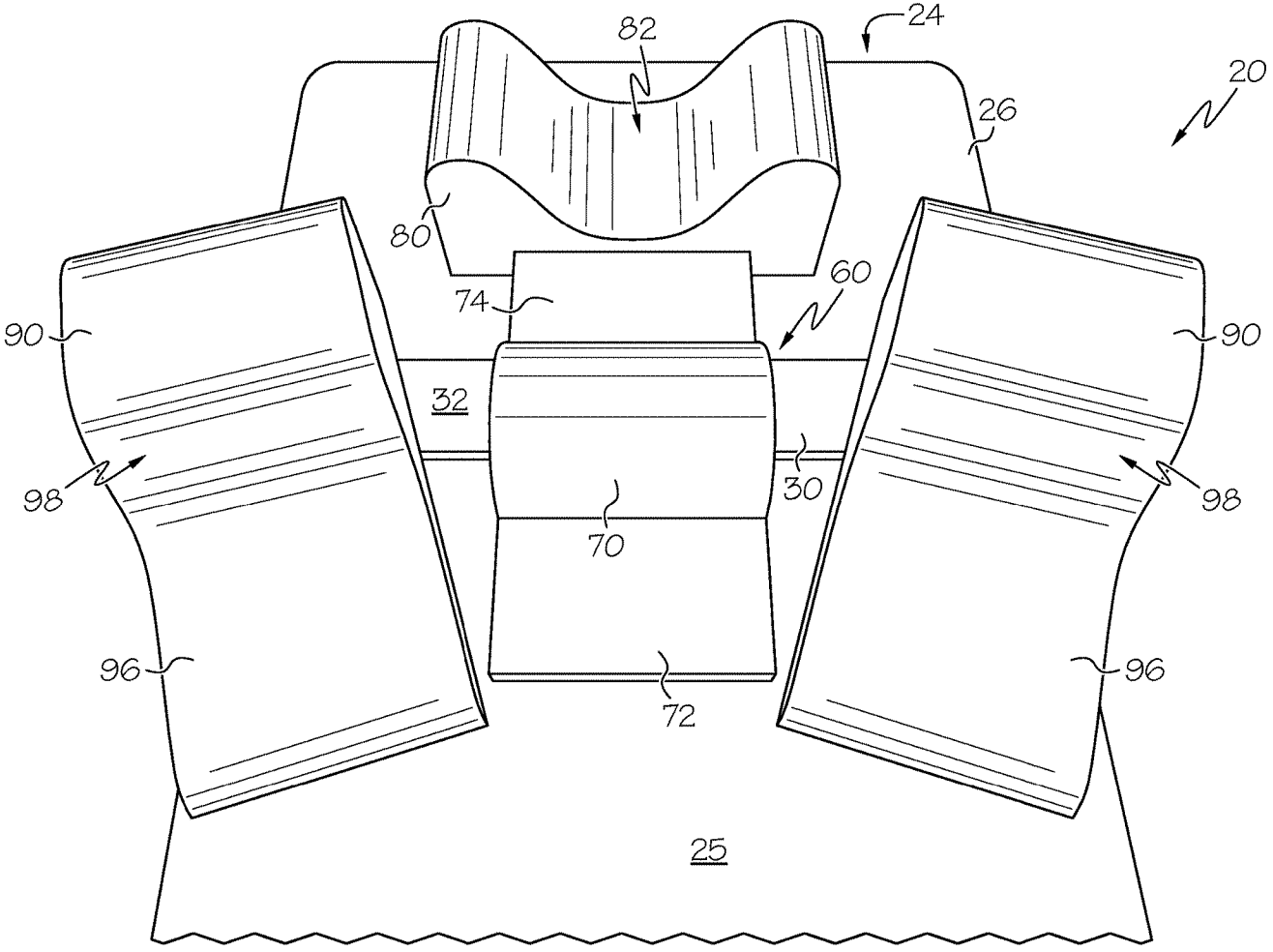
FIG. 7 illustrates a top view of the patient positioning device including an example restraint, example head stabilizer, and a pair of example lateral stabilizing pillows.
Figure 8:
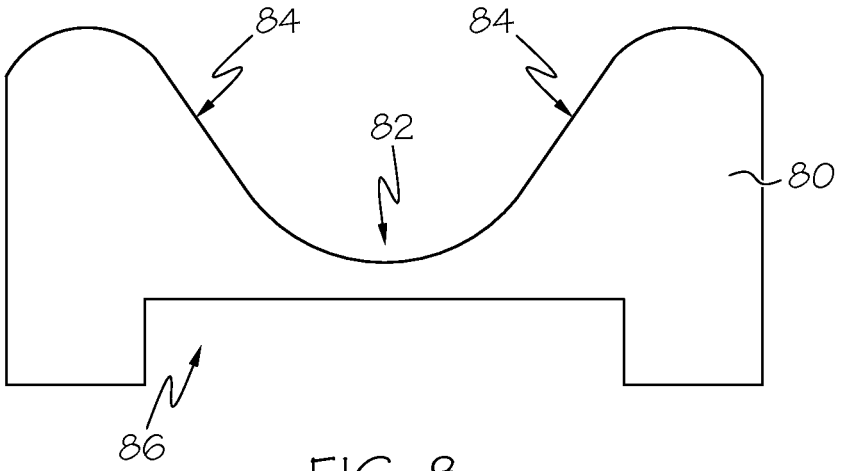
FIG. 8 illustrates a front view of an example head stabilizer.
Figure 9:
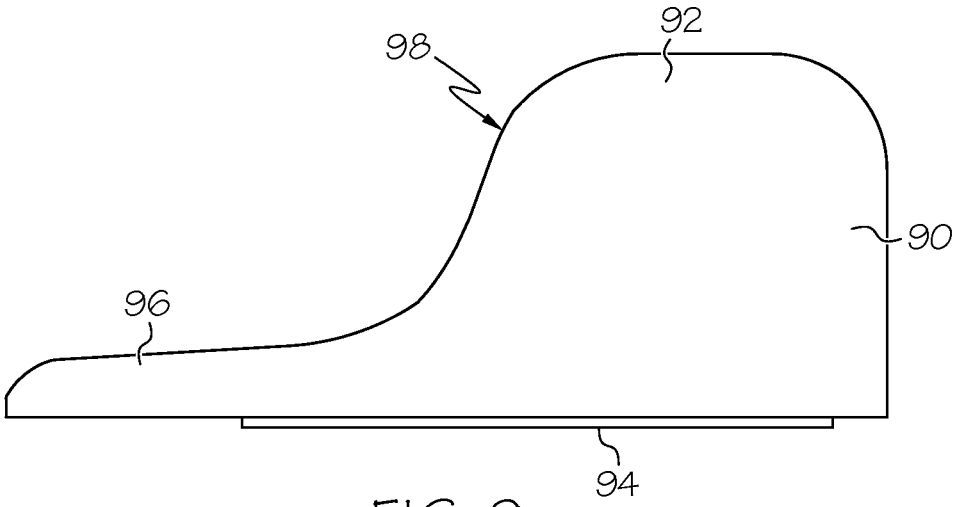
FIG. 9 illustrates a side view of an example lateral stabilizing pillows.

Turning now to FIGS. 7-9, the patient positioning device 20 may further include additional supports or stabilizers to resist other movement of the body 22 and/or to increase patent comfort. In one example, a head stabilizer 80 overlies at least part of the base 62 of the cervical-thoracic notch restraint 60 and includes a recess 82 configured to at least partially receive the occiput of the head 27 of the body 22 to inhibit lateral movement of the head 27. The recess 82 extends at least partially into the head stabilizer 80 to receive the patient's head, and may further comprise a channel that extends completely through the head stabilizer 80. Additionally, the recess 82 can have various geometries, such as U-shaped or V-shaped geometry. The internal sides 84 of the recess 82 can have a tapered or ramped geometry that can help to self-center the patient's head 27 within the recess 82, and provide a more form-fitting stabilizer to further reduce lateral movement of the head 27.

The head stabilizer 80 further includes a cutout section 86 on a bottom surface thereof that is sized to overly and receive at least part of the second extended portion 74 of the base 62. The cutout section 86 can have various geometries, such as a rectangular geometry or other desired geometry, and can have a height and width at least equal to, and preferably somewhat greater than, the corresponding height and width of the second extended portion 74. Thus, the cutout section 86 can be longitudinally positioned to fit the head location of each unique patient and resist lateral movement via engagement with the second extended portion 74 of the base 62. The head stabilizer 80 can be retained in position by gravity and the weight of the patient's head 27, although a suitable fastener (such as a hook-and-loop type fastener) could be applied between the head stabilizer 80 and the second extended portion 74 of the base 62.

The patient positioning device 20 may further include additional supports or stabilizers, such as at least one lateral stabilizing pillow 90. The lateral stabilizing pillow 90 can be secured to the upper surface 32 of the support frame 30 and includes a raised, curved stabilizer element 92 configured to abut a shoulder of the body 22 lying over the table 26 to inhibit torsional movement of the body 22. Preferably, a pair of independent lateral stabilizing pillows 90 are used to independently stabilize opposite sides of the body 22. Still, various other numbers of lateral stabilizing pillows may also be used.

Each lateral stabilizing pillow 90 includes a repositionable fastener 94 on an underside surface that is compatible with and securely fixed to the repositionable fastener 50 on the upper surface 32 of the support frame 30. Preferably, the repositionable fasteners 50, 94 are a hook-and-loop type fastener, although any other type of fastener described herein may be used. The repositionable fastener 94 is applied to a sufficient portion of the underside surface to enable the lateral stabilizing pillow 90 to be positionally adjustable upon the upper support surface 32 of the support frame 30. Thus, the lateral stabilizing pillow 90 can allow relatively infinite adjustment, placement and re-adjustment of its location and orientation projecting horizontally, vertically, laterally or obliquely relative to the support frame 30 in order to meet the unique anatomical requirements of each patient. For example, as shown in FIG. 7, each lateral stabilizing pillow 90 may be angled, relative to the longitudinal axis 29 of the table 26, to fit properly against the patient's shoulders and also to further inhibit torsional movement of the body 22.

Each lateral stabilizing pillow 90 may further include a relatively thin base 96 that is intended to be at least partially received under the patient. The base 96 ramps upwards, possibly at a steep angle, to provide the raised, curved stabilizer element 92 and present a curved shoulder bolster 98 towards the patient. The geometry between the base 96 and the curved shoulder bolster 98 is designed to conform and rest against the shoulders of the patient so as to resist torsional movement of the body 22. Additionally, the curved shoulder bolster 98 is relatively thick such that, as the shoulders rest against them, the curved shoulder bolster 98 may deform inwardly somewhat to conform to the patient.

The head stabilizer 80 and lateral stabilizing pillows 90 can be made from various materials, and each is preferably formed as a monolithic body utilizing a single material. Still, they can be formed of multiple components and/or multiple materials. The material used should provide stability for patients ranging from 45 lbs to greater than 450 lbs, and preferably greater than 750 lbs. Additionally, the material can be a natural or synthetic material in such a size or density that will maintain its shape and function and provide and maintain sufficient resistance to the patient's weight and gravity to thereby causing the human body 22 to remain fixed in position upon the surface of the table 26. In one example, the head stabilizer 80 and lateral stabilizing pillows 90 can be made of a resiliently deformable material, such as a foam material. Thus, any of the cervical-thoracic notch restraint 60, head stabilizer 80 and lateral stabilizing pillows 90 can be disposable, limited use or reusable.

The cervical-thoracic notch restraint 60 is intended to be load-bearing to primarily stabilize the patient along the longitudinal axis of their spine, and thereby support the body 22 against longitudinal movement on the table 26. Conversely, the head stabilizer 80 and lateral stabilizing pillows 90 are not intended to be longitudinally load-bearing and are only used stabilize the body 22 against lateral and/or torsional movement. Thus, although also made from a foam material, the cervical-thoracic notch restraint 60 can be made of a different foam material that has a greater density than either of the foam materials of the head stabilizer 80 and lateral stabilizing pillows 90. As a result, the head stabilizer 80 and lateral stabilizing pillows 90 are intended to be relatively more malleable than the cervical-thoracic notch restraint 60.

In one example, the head stabilizer 80 and lateral stabilizing pillows 90 are made of polyether-type polyurethane foam and has a density of at least 1 lbs per cubic foot, and more preferably at least 1.8 lbs per cubic foot. Additionally, the foam material preferably has an indentation load deflection (ILD) rating of at least 30 lbs., more preferably at least 40 lbs. Again, because the head stabilizer 80 and lateral stabilizing pillows 90 are used as stabilizers, the foam material of the cervical-thoracic notch restraint 60 is preferably at least 50% more resistant to indentation than the foam material of the head stabilizer 80 and the lateral stabilizing pillows 90. For example, if the ILD of the head stabilizer 80 or the lateral stabilizing pillows 90 is at least 40 lbs., the ILD of the cervical-thoracic notch restraint 60 is preferably at least 60 lbs. As a result, more resisting force will naturally be provided by the cervical-thoracic notch restraint 60. It is understood that the example load ratings described above are only examples, and other values are contemplated. Further, the head stabilizer 80 and any or all of the lateral stabilizing pillows 90 can have similar or different material characteristics.

Taken together, FIG. 7 illustrates one example patient positioning device 20 including the support frame 30, the cervical-thoracic notch restraint 60, one head stabilizer 80, and two lateral stabilizing pillows 90. For example, the lateral stabilizing pillows 90 are attached laterally on the outward portions 49 of the support frame 30 utilizing an aggressive releasable fastener that is compatible with the aggressive releasable fastener 50 attached to the support frame 30. Additionally, the head stabilizer 80 is seated over the top of the cervical-thoracic notch restraint 60 by utilizing the cutout 86 in the bottom of the head stabilizer 80. It is understood that the shown and described configurations are not intended to present a limitation upon the instant applications, and other configurations of restraints, supports or stabilizers are contemplated.

In some embodiments, patient restraints, supports and stabilizers may be attached to and project from the frame and are secured to the top of the frame using aggressive, releasable, repositionable fasteners compatible with a corresponding fastener utilized on the support frame. The fasteners permit infinite adjustment and relocation of patient restraints, supports or stabilizers said devices being placed on, against or near appropriate anatomical structures or landmarks of the patient's body.

In some embodiments, multiple support frames can be so mounted so as to simultaneously support multiple locations on the anatomy of a patient upon the surgical table.

In some embodiments the patient positioning device combines the use of several restraint, support or stabilizing devices as described herein to restrain patients from moving on the surgical table.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A patient positioning device for restraining movement of a body lying over a top surface of a table with a rigid support frame secured to and extending transversely over said top surface of said table, comprising:

a cervical-thoracic notch restraint formed of a resiliently deformable material and comprising:

a base comprising a first side and an opposed second side, the first side defining a substantially flat plane with a repositionable fastener configured to be securely fixed to an upper support surface of said support frame to thereby inhibit movement of the cervical-thoracic notch restraint along a longitudinal axis of said table, and the second side defining a substantially flat plane with a raised, curved support extending transversely across the base and comprising a mound prominently extending upwards from the substantially flat plane of the second side, wherein, in an operational state, the curved support is configured to nest into an anatomical cervical-thoracic notch of said body lying over said table to abut a trapezius muscle of said body, and the curved support is load-bearing to thereby apply a resisting force against the trapezius muscle and a spinal column of said body that is sufficient to substantially completely resist movement of said body along the longitudinal axis of said table.

2. The patient positioning device of claim 1, wherein the base of the cervical-thoracic notch restraint comprises at least one extended portion adjacent the base of the cervical-thoracic notch restraint.

3. The patient positioning device of claim 2, wherein the base of the cervical-thoracic notch restraint comprises both of a first extended portion and a relatively longer second extended portion, and the raised, curved support being located between the first and second extended portions, and wherein the first and second extended portions are parallel along the longitudinal axis of said table.

4. The patient positioning device of claim 2, wherein the base of the cervical-thoracic notch restraint comprises both of a first extended portion and a second extended portion, and the raised, curved support being located between the first and second extended portions, and wherein at least one of the first and second extended portions comprises a tapered geometry leading towards the raised, curved support.

5. The patient positioning device of claim 1, wherein the raised, curved support comprises one or more compound curves, or a singular transverse tubular radius.

6. The patient positioning device of claim 5, wherein the raised, curved support comprises a semi-circular geometry of a substantially constant radius.

7. The patient positioning device of claim 1, wherein the raised, curved support has a geometry compatible with and conforming to an anatomical shape of the nucha of said body lying over said table.

8. The patient positioning device of claim 1, wherein the cervical-thoracic notch restraint comprises a monolithic body that is made of a foam material.

9. The patient positioning device of claim 8, wherein the foam material is polyurethane foam that has a density of at least 2 lbs per cubic foot.

10. The patient positioning device of claim 1, wherein the repositionable fastener comprises a hook-and-loop type fastener.

11. A patient positioning device for restraining movement of a body lying over a top surface of a table, comprising:

a rigid support frame secured to and extending transversely over the top surface of said table, comprising an upper support surface and a repositionable fastener secured to the upper support surface; and a cervical-thoracic notch restraint including a load-bearing resilient foam material and securely fixed to the upper support surface of the support frame, via the repositionable fastener, to thereby inhibit movement of the cervical-thoracic notch restraint along a longitudinal axis of said table, comprising:

a base with a first side and a second side, the first side comprising a repositionable fastener compatible with the repositionable fastener of the upper support surface, and the second side defining a substantially flat plane with a first extended portion and a second extended portion, and comprising a raised, curved support located between the first and second extended portions and comprising a mound prominently extending upwards from the second side of the base that, in an operational state, is configured to nest into an anatomical cervical-thoracic notch of said body lying over said table and abut a trapezius muscle of said body to thereby apply a resisting force against the trapezius muscle and a spinal column of said body that is sufficient to substantially completely resist movement of said body along the longitudinal axis of said table, wherein the resilient foam material of the cervical-thoracic notch restraint is sufficiently load-bearing to maintain contact with the trapezius muscle of said body and support a force of at least 450 pounds directed along the longitudinal axis of said table when the top surface of said table is oriented in an inclined position relative to a ground surface.

12. The patient positioning device of claim 11, wherein the repositionable fastener of the support frame comprises a hook-and-loop type fastener.

13. The patient positioning device of claim 11, wherein the support frame further comprises an extension plate, located about a central portion of the support frame, that increases a length of the upper support surface in a direction along the longitudinal axis of said table to thereby provide a combined attachment surface area of the upper support surface along the longitudinal axis of said table, and wherein the repositionable fastener of the support frame comprises a holding strength per unit of surface area that, when applied over said combined attachment surface area, is sufficient to support a force of at least 450 pounds directed along the longitudinal axis of said table when the top surface of said table is oriented in said inclined position relative to said ground surface.

14. The patient positioning device of claim 11, wherein at least one of the first and second extended portions comprises a tapered geometry leading towards the raised, curved support.

15. The patient positioning device of claim 11, wherein the raised, curved support comprises one or more compound curves, or a singular transverse tubular radius.

16. The patient positioning device of claim 15, wherein the raised, curved support comprises a semi-circular geometry of a substantially constant radius.

17. The patient positioning device of claim 11, wherein the raised, curved support has a geometry compatible with and conforming to an anatomical shape of the nucha of said body lying over said table.

18. The patient positioning device of claim 11, wherein the cervical-thoracic notch restraint comprises a monolithic body that is made of a foam material.

19. The patient positioning device of claim 18, wherein the foam material is polyurethane foam that has a density of at least 2 lbs per cubic foot.

20. The patient positioning device of claim 11, wherein the cervical-thoracic notch restraint is co-manufactured using two or more materials.

* * * * *